US007004852B2

(12) United States Patent
Billings

(10) Patent No.: US 7,004,852 B2
(45) Date of Patent: Feb. 28, 2006

(54) CUSTOMIZABLE CENTER-OF-GRAVITY GOLF CLUB HEAD

(75) Inventor: David P. Billings, McKinney, TX (US)

(73) Assignee: DogLeg Right Corporation, Dallas, TX (US)

( * ) Notice: Subject to any disclaimer, the term of this patent is extended or adjusted under 35 U.S.C. 154(b) by 0 days.

(21) Appl. No.: 10/043,421

(22) Filed: Jan. 10, 2002

(65) Prior Publication Data

US 2003/0130059 A1 Jul. 10, 2003

(51) Int. Cl.
*A63B 53/04* (2006.01)

(52) U.S. Cl. ..... 473/332; 473/334; 473/338; 473/339; 473/349

(58) Field of Classification Search ..... 473/324, 473/332, 333, 334, 335, 336, 337, 338, 339, 473/340, 341, 349, 350, 256, 345, 346
See application file for complete search history.

(56) References Cited

U.S. PATENT DOCUMENTS

| | | | | | |
|---|---|---|---|---|---|
| 2,163,091 | A | * | 6/1939 | Held | |
| 3,075,768 | A | * | 1/1963 | Karns | |
| 3,143,349 | A | * | 8/1964 | MacIntyre | 473/338 |
| 3,606,327 | A | * | 9/1971 | Gorman | |
| 3,652,094 | A | | 3/1972 | Glover | |
| 3,749,408 | A | * | 7/1973 | Mills | |
| 4,085,934 | A | * | 4/1978 | Churchward | |
| 4,214,754 | A | * | 7/1980 | Zebelean | 473/346 |
| 4,340,230 | A | * | 7/1982 | Churchward | |
| 4,432,549 | A | * | 2/1984 | Zebelean | 473/346 |
| 4,502,687 | A | * | 3/1985 | Kochevar | 473/346 |
| 4,655,459 | A | * | 4/1987 | Antonious | 473/338 |
| 4,811,950 | A | * | 3/1989 | Kobayashi | |
| 4,824,116 | A | * | 4/1989 | Nagamoto et al. | 473/338 |
| 4,869,507 | A | * | 9/1989 | Sahm | |
| 5,013,041 | A | * | 5/1991 | Sun et al. | 473/252 |
| 5,050,879 | A | * | 9/1991 | Sun | |
| 5,056,705 | A | * | 10/1991 | Wakita et al. | 228/176 |
| 5,082,278 | A | * | 1/1992 | Hsien | |
| 5,244,210 | A | * | 9/1993 | Au | |
| 5,273,283 | A | * | 12/1993 | Bowland | |
| 5,316,298 | A | * | 5/1994 | Hutin et al. | 473/332 |
| 5,351,958 | A | * | 10/1994 | Helmstetter | 473/346 |
| 5,385,348 | A | * | 1/1995 | Wargo | |
| 5,518,243 | A | * | 5/1996 | Redman | |
| 5,558,226 | A | * | 9/1996 | Fritz | 206/457 |
| 5,755,624 | A | * | 5/1998 | Helmstetter | 473/291 |
| 5,797,807 | A | * | 8/1998 | Moore | 473/345 |
| 5,961,394 | A | * | 10/1999 | Minabe | 473/305 |
| 6,030,295 | A | * | 2/2000 | Takeda | 473/345 |
| 6,089,994 | A | * | 7/2000 | Sun | |
| 6,206,790 | B1 | | 3/2001 | Kubica et al. | |
| 6,248,025 | B1 | | 6/2001 | Murphy et al. | |
| 6,254,494 | B1 | | 7/2001 | Hasebe et al. | |
| 6,306,048 | B1 | | 10/2001 | McCabe et al. | |
| 6,315,678 | B1 | * | 11/2001 | Teramoto | 473/291 |
| 6,364,788 | B1 | * | 4/2002 | Helmstetter et al. | 473/324 |

* cited by examiner

*Primary Examiner*—Sebastiano Passaniti
(74) *Attorney, Agent, or Firm*—Carr LLP

(57) ABSTRACT

A golf club head that allows a user to customize the location of the center of gravity. The golf club head comprises a club head having a hollow cavity with a weighting port. The weighting port allows a user to place weighting material inside the hollow cavity, customizing the location of the center of gravity, the swing weight, the total weight, and the balance of the golf club.

7 Claims, 3 Drawing Sheets

CUSTOMIZABLE CENTER-OF-GRAVITY GOLF CLUB HEAD

FIELD OF THE INVENTION

The invention relates generally to golf clubs and, more particularly, to a golf club head in which the center of gravity, balance, and weight are customizable and can be altered to suit changing course conditions, weather conditions, and other user requirements.

BACKGROUND OF THE INVENTION

Golfers have long recognized that they could alter the weight, balance, and performance characteristics by selectively adding weight to club heads. Typically, weight is added by applying thin strips of lead tape with an adhesive backing to the club head. In this manner the swing weight is increased and the center of gravity (CG) is altered to change the dynamics of the head during the swing and, therefore, the ball flight characteristics after contact. The location of the lead tape, however, is generally limited to the back, crown, and sole of the club heads, where it would best stay affixed and not alter the look of the club. However, this limits the adjustability options available to the golfer. For example, the lead tape can not be put on the face of the club to move the CG closer to the front of the club. Forward movement of the center of gravity is more desirable to some golfers who want the club to be easier to "work", that is, to shape shots both in a left-to-right manner and in a right-to-left manner.

Furthermore, use of lead tape is generally an additive process, increasing the swing weight and total weight of the club was increased and oftentimes negatively affecting other performance characteristics of the club. Some golfers attempt to overcome this obstacle by grinding down or using other means to reduce the weight of the club. However, this often damages the protective finish of the club or the shape and configuration intended by the club designer, negatively affects the after market value of the club, and is both difficult and time-consuming for the golfer to adjust.

Furthermore, manufacturers of golf clubs have encountered problems manufacturing individual clubs to identical specifications, because of variances of the individual components themselves and when assembled together. Generally, manufacturers build clubs to a weight at, or slightly below, a targeted weight specification and then add additional weight to either or both of the head and the shaft, as desired, to increase either or both of the total weight and the swing weight to the desired specification. Additional weight is commonly added by pouring lead powder into the bottom of the shaft and sealing the shaft with a cork or other means. Alternatively, lead powder is mixed with putty, epoxy, or other materials that are inserted into the end of the shaft of the assembled head and shaft to facilitate this final weight adjustment by the manufacturer. These methods, however, may alter the CG of the club away from the optimal location, adversely effecting performance and feel.

Additionally, a common practice is to inject a hot melt glue or similar material into a hole in the club head during final assembly to arrive at a prescribed swing weight. The location that the glue puddles and adheres to the inner walls is determined by the orientation of the head while the glue is still hot and fluid. This technique is also used to customize the center of gravity of the club head for specific golfers' needs. The location of the glue, however, is generally limited to one broad area due to the closed process, and once the glue is set, the glue is not adjustable.

Therefore, there is a need for a golf club head with a customizable CG that allows the CG to be altered by either or both the golfer and the manufacturer, both prior to and following final manufacture.

SUMMARY

The present invention provides a golf club that allows a user to customize the location of the center of gravity.

The golf club comprises club head having a hollow cavity with a weighting port that allows the user to access the cavity. The weighting port allows a user to place weighting material inside the golf club head, thereby adjusting or customizing the location of the center of gravity.

BRIEF DESCRIPTION OF THE DRAWINGS

For a more complete understanding of the present invention, and the advantages thereof, reference is now made to the following description taken in conjunction with the accompanying drawings, in which.

DETAILED DESCRIPTION

Figure 1:
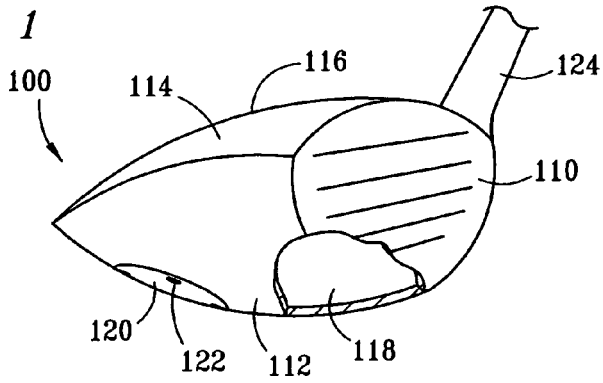
FIG. 1 illustrates a metal golf club head that embodies features of the present invention.

Referring to FIG. 1 of the drawings, the reference numeral 100 generally designates a hollow golf club head embodying features of the present invention. The hollow golf club head 100 generally comprises a face portion 110, a sole and wall portion 112, and a crown portion 114 defining a housing or body 116 with an interior cavity 118. A hosel portion 124 is connected to and/or integrated into the body 116 for receiving a shaft (not shown). A removable port cover 120 provides access to the interior cavity 118, allowing placement of weighting material, such as lead tape, into the interior cavity 118.

In the preferred embodiment, the hollow golf club head 100 comprises a two-piece golf club head. The first piece comprises the sole and wall portion 112 and the face portion 110, including the hosel portion 124. The second piece comprises the crown portion 114, which is welded or otherwise attached to the first piece. The present invention is not limited, however, to use with any particular construction of a golf club head, and may be utilized in single-piece and three-piece heads, as well as club heads constructed from any number of pieces.

Figure 2:
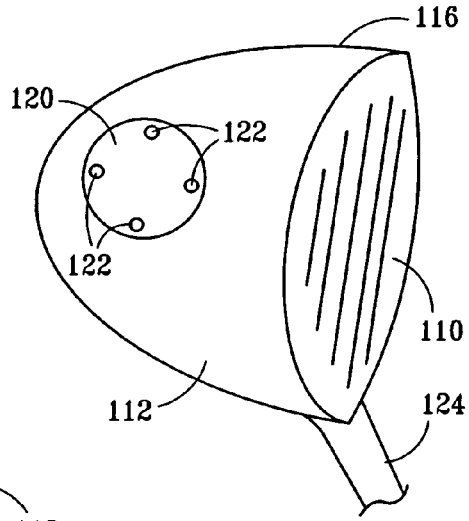
FIG. 2 illustrates a bottom view of a metal golf club head that embodies features of the present invention.

FIG. 2 is a bottom view of the hollow golf club head 100, further illustrating the positioning and sizing of the weighting-port cover 120 in the preferred embodiment. Preferably, the weighting-port cover 120 is positioned on the bottom or sole of the hollow golf club head 100 and away from the face portion 110. The weighting-port cover 120 is preferably positioned such that the weighting-port cover 120 is not visible by a golfer when addressing a golf ball. Furthermore, the placement of the weighting-port cover 120 away from the face portion 110 allows placement of weighting material about, or on, the interior side of the face portion 110, and along the heal and toe portions of the hollow golf club head 100.

The weighting port cover 120 is preferably attached to the body 116 via a plurality of flush-mounted bolts 122, and, optionally, may be coated with a friction-reducing material, such as Teflon. In order to reduce the friction, the possibility of the weighting-port cover "snagging" on grass, thereby affecting the swing path, and the associated wear and tear, the weighting-port cover 120 is flush-mounted to the sole and wall portion 112 by the plurality of flush-mounted bolts 122.

Figure 3:
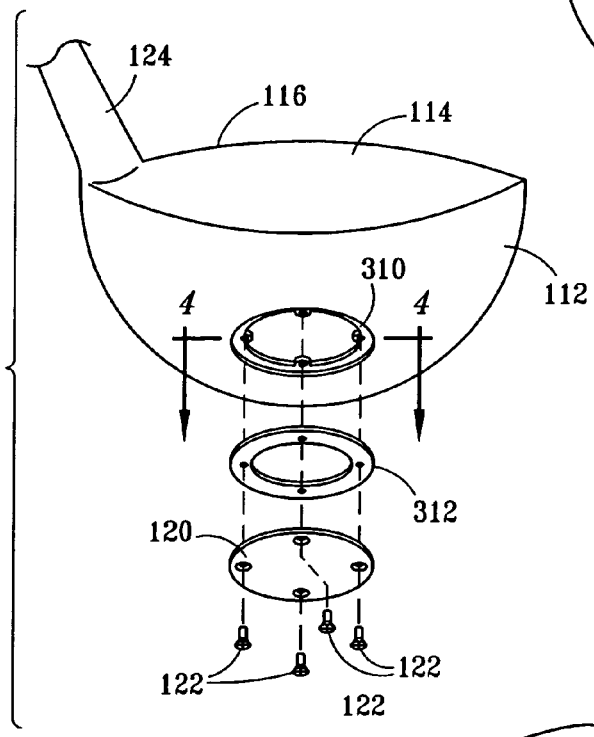
FIG. 3 illustrates a rear view of a metal golf club head with a weighting port cover removed that embodies features of the present invention.

FIG. 3 illustrates the hollow golf club head 100 with the weighting-port cover 120 removed. The body 116 preferably includes a recessed portion 310 configured for receiving an optional vibration-dampening ring 312 and the weighting-port cover 120. The vibration-dampening ring 312, such as a ring made from foam, rubber, and/or the like, allows the weighting-port cover 120 to be securely fastened, preventing a vibration or rattling noise that may occur as a result of swinging the club, moving the club, or striking a ball. The vibration-dampening ring 312 also seals the interior cavity 118 from exposure to outside elements, such as sand, water, or the like.

The plurality of flush-mounted bolts 122 pass through the weighting-port cover 120 and screw into the recessed portion 310 of the body 116. Alternatively, other means and methods of attaching the weighting-port cover 120 may be used, such as a weighting-port cover that screws into the body 116, latches, press-fits, or the like. The preferred embodiment utilizes a weighting-port cover 120 that is curved to match the contour of the body.

Figure 4:
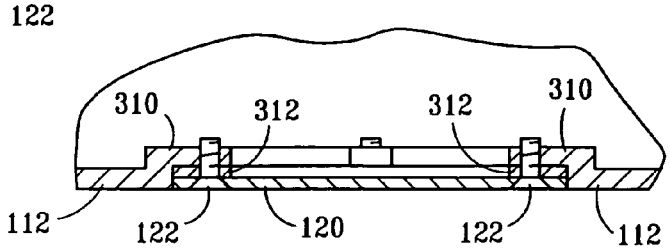
FIG. 4 illustrates a cross-section view with the weighting port cover attached that embodies features of the present invention.

FIG. 4 illustrates a side view of the weighting-port cover 120 attached to the body 116 in accordance the embodiment of the present invention depicted in FIG. 3. As one skilled in the art will appreciate, the recessed portion 310 allows a flush mounting and a smooth contour to be formed when the sole and wall portion 112 and the weighting-port cover 120 are assembled. Alternatively, the weighting-port cover 120 could be recessed from the sole and wall portion, if desired.

Figure 5:
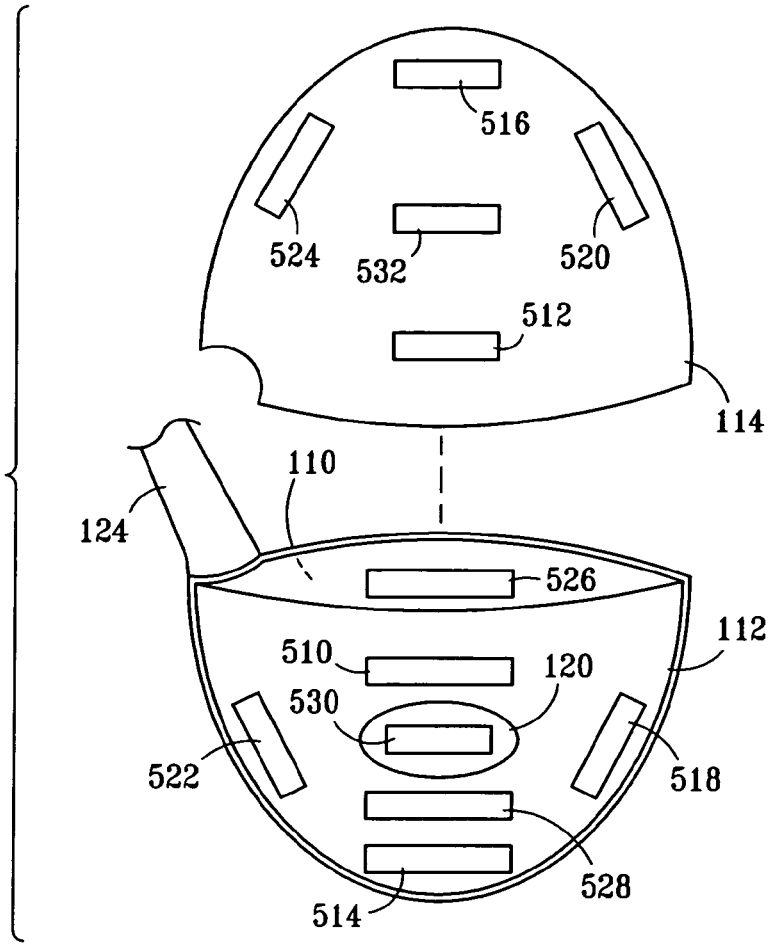
FIG. 5 illustrates a metal golf club head with the crown portion removed to indicate some positions of weighting material.

FIG. 5 illustrates the hollow golf club head 100 with the crown portion 114 separated from the sole and wall portion 112 and rotated to face the inner wall towards the reader in order to illustrate potential placements of weighting material in accordance with embodiments of the present invention. The illustrated positions are presented for illustrative purposes only and, therefore, should not limit the present invention in any manner. Furthermore, the positions shown may be used individually or in combination to further customize the location of the center of gravity.

Weight location 510 illustrates a low-front-center location, which is located on the integrated sole and wall portion 112 adjacent to the face portion 110, that tends to impart less spin on the ball and a higher trajectory, resulting in easier workability (the ability to hit the ball from left to right and vice versa) and more carry (the distance the ball travels in the air).

Weight location 512 illustrates a high-front-center location, which is located on the crown portion 114 adjacent to the face portion, that tends to impart less spin on the ball and a lower trajectory, resulting in easier workability, less carry, and more rolling.

Weight location 514 illustrates a low-back-center location, which is located on the back-center of the sole and wall portion 112, that tends to result in more forgiveness and a higher trajectory.

Weight location 516 illustrates a high-back-center location, which is located on the back-center of the crown portion 114, that tends to result in more forgiveness and a lower trajectory.

Weight location 518 illustrates a low-back-toe location, which is located on the back-center of the integrated sole and wall portion 112 along the toe, that tends to result in more forgiveness and a higher, fading trajectory.

Weight location 520 illustrates a high-back-toe location, which is located on the back-center of the crown portion 114 along the toe, that tends to result in more forgiveness and a lower, fading trajectory.

Weight location 522 illustrates a low-back-heel location, which is located on the back-center of the integrated sole and wall portion 112 along the heel, that tends to result in more forgiveness and a higher, drawing trajectory.

Weight location 524 illustrates a high-back-heel location, which is located on the back-center of the crown portion 114 along the heel, that tends to result in more forgiveness and a lower, drawing trajectory.

Weight location 526 illustrates a forward-center-center location, which is located on the center of the face portion 110, that tends to result in easier workability with a neutral trajectory.

Weight location 528 illustrates a back-center-center location, which is located in the vertical-center of the integrated sole and wall portion 112, that tends to result in neutrally forgiving club head.

Weight location 530 illustrates a low-center-center location, which is located on the center of the integrated sole and wall portion 112, that tends to result in a neutral side-spin with a higher trajectory. Note that this location is located on the weighting-port cover 120 for illustrative purposes only. As stated above, the weighting-port cover 120 may be located at any desired location, and a weight may be placed on the weighting-port cover 120 if so desired.

Weight location 532 illustrates a high-center-center location, which is located in the center of the crown portion 114, that tends to result in a neutral side-spin with a lower trajectory.

Figure 6:
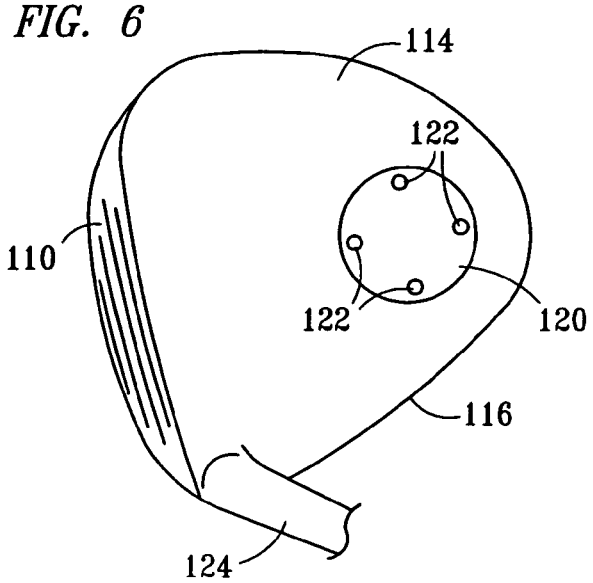
FIG. 6 illustrates a metal driver head embodying features of the present invention.

FIG. 6 illustrates a driver golf club head embodying features of the present invention in which the weighting-port cover 120 is located on the crown portion 114.

Figure 7:
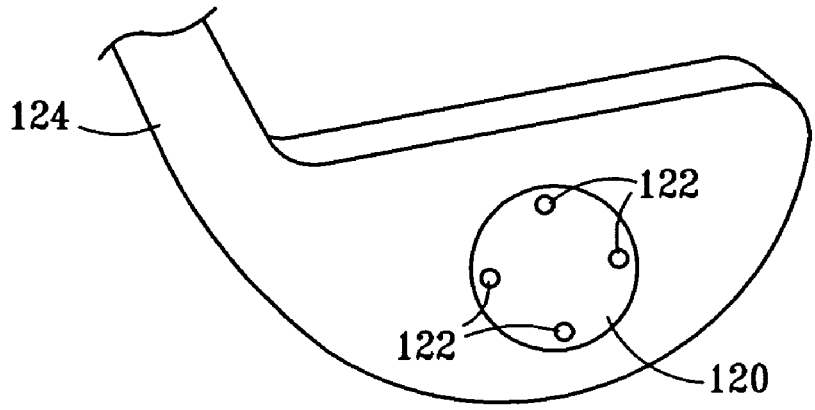
FIG. 7 illustrates a metal iron golf club head embodying features of the present invention.

FIG. 7 illustrates a hollow, iron golf club head embodying features of the present invention in which a weighting-port cover 710 is provided.

Figure 8:
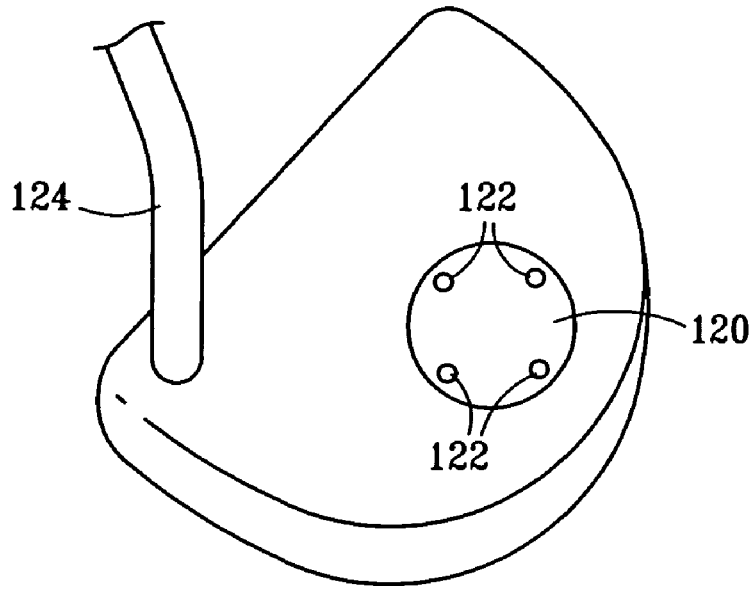
FIG. 8 illustrates a metal putter head embodying features of the present invention.

FIG. 8 illustrates a hollow, putter golf club head embodying features of the present invention in which a weighting-port cover 810 is provided.

It should be noted that the placement and size of the weighting port is shown for illustrative purposes only, and, therefore, should not limit the present invention in any manner.

It is understood that the present invention can take many forms and embodiments. Accordingly, several variations may be made in the foregoing without departing from the spirit or the scope of the invention. For example, the weighting port may be of a different shape and/or there may be a different method of accessing the interior of the club head, such as removing the sole of the club head, the back of the club head, or the like.

Having thus described the present invention by reference to certain of its preferred embodiments, it is noted that the embodiments disclosed are illustrative rather than limiting in nature and that a wide range of variations, modifications, changes, and substitutions are contemplated in the foregoing disclosure and, in some instances, some features of the present invention may be employed without a corresponding use of the other features. Many such variations and modifications may be considered obvious and desirable by those skilled in the art based upon a review of the foregoing description of preferred embodiments. Accordingly, it is appropriate that the appended claims be construed broadly and in a manner consistent with the scope of the invention.

What is claimed is:

1. A golf club head comprising:

a relatively thin shell comprising a plurality of walls that collectively form a hollow body with a substantially empty or voided cavity;

said club head having an opening defined therein;

a plurality of weights readily user-repositionably secured to said shell of said club head at readily user-accessible spaced-apart locations along the walls of the shell to adjust the center of gravity of the golf club head; and a user-accessible threadably attachable member threadably attached to the opening, said threadably attachable member having a weight user-repositionably secured thereon;

at least one of said weights being securable in a location that is substantially non-co-linear with the others of said weights to permit adjustment of the center of gravity of the golf club head in at least two axes, at least one of said weights being user-repositionably disposable near the rear of the club head, left of the center-line of the head, at least one of said weights being user-repositionably disposable near the rear of the club head, right of the center-line of the head, at least one of said weights being user-repositionably disposable near the front of said club head, each of said weights being interchangeably repositionable by the user at each of said locations.

2. The golf club head of claim 1, further comprising a vibration-dampening material interposed between the threadably attachable member and the opening formed though the housing.

3. A golf club head having an adjustable center of gravity, comprising:

a relatively thin shell comprising a plurality of walls that collectively form a hollow body with a substantially empty or voided cavity;

an opening into said cavity;

a removable cover for selectively covering and uncovering the opening;

a plurality of weights readily user-repositionably secured to said shell of said club head at readily user-accessible spaced-apart locations along the walls of the shell to adjust the center of gravity of the golf club; and a vibration-dampener interposed between the weighting port cover and the body to reduce vibration of the cover;

at least one of said weights being securable in a location that is substantially non-co-linear with the others of said weights to permit adjustment of the center of gravity of the golf club head in at least two axes, at least one of said weights being user-repositionably disposable near the rear of the club head, left of the center-line of the head, at least one of said weights being user-repositionably disposable near the rear of the club head, right of the center-line of the head, at least one of said weights being user-repositionably disposable near the front of said club head, each of said weights being interchangeably repositionable by the user at each of said locations.

4. A golf club head having an adjustable center of gravity, comprising:

a relatively thin shell comprising a plurality of walls that collectively form a hollow body with a substantially empty or voided cavity;

an opening into said cavity;

a removable cover for selectively covering and uncovering the opening;

a plurality of weights readily user-repositionably secured to said shell of said club head at readily user-accessible spaced-apart locations along the walls of the shell to adjust the center of gravity of the golf club; and a vibration dampener secured to the closure of the opening;

at least one of said weights being securable in a location that is substantially non-co-linear with the others of said weights to permit adjustment of the center of gravity of the golf club head in at least two axes, at least one of said weights being user-repositionably disposable near the rear of the club head, left of the center-line of the head, at least one of said weights being user-repositionably disposable near the rear of the club head, right of the center-line of the head, at least one of said weights being user-repositionably disposable near the front of said club head, each of said weights being interchangeably repositionable by the user at each of said locations.

5. A golf club head with an adjustable center of gravity, comprising:

a relatively thin shell comprising a plurality of walls that collectively form a hollow body with a substantially empty or voided cavity;

an opening;

a plurality of weights readily user-repositionably secured to said shell of said club head at readily user-accessible spaced-apart locations along the walls of the shell to adjust the center of gravity of the golf club head;

at least one of said weights being securable in a location that is substantially non-co-linear with the others of said weights to permit adjustment of the center of gravity of the golf club head in at least two axes, at least one of said weights being user-repositionably disposable near the rear of the club head, left of the center-line of the head, at least one of said weights being user-repositionably disposable near the rear of the club head, right of the center-line of the head, at least one of said weights being user-repositionably disposable near the front of said club head, each of said weights being interchangeably repositionable by the user at each of said locations;

a closure for covering the opening into the cavity following placement of said weights within the cavity; and a dampener for reducing vibration of the closure when the closure covers the opening.

6. The golf club head of claim 5, wherein the dampener comprises vibration dampening material compressed between at least a portion of the housing and the closure.

7. The golf club head of claim 5, wherein the dampener is in contact with the closure.

* * * * *

UNITED STATES PATENT AND TRADEMARK OFFICE

CERTIFICATE OF CORRECTION

PATENT NO. : 7,004,852 B2
APPLICATION NO. : 10/043421
DATED : February 28, 2006
INVENTOR(S) : David P. Billings It is certified that error appears in the above-identified patent and that said Letters Patent is hereby corrected as shown below:

On the title page Item [56] References Cited, after "5,082,278 A * 1/1992 Hsien" insert --5,184,823 A * 2/1993 Desbiolles-- and; after "5,385,348 A * 1/1995 Wargo" insert --5,447,309 A * 9/1995 Vincent--.

Column 3, line 9, "heal" should be changed to --heel--.

Signed and Sealed this

Twenty-fourth Day of April, 2007

JON W. DUDAS
*Director of the United States Patent and Trademark Office*

US007004852C1

(12) INTER PARTES REEXAMINATION CERTIFICATE (639th)

United States Patent

Billings

(10) Number: US 7,004,852 C1

(45) Certificate Issued: Jul. 17, 2013

(54) CUSTOMIZABLE CENTER-OF-GRAVITY GOLF CLUB HEAD

(75) Inventor: David P. Billings, McKinney, TX (US)

(73) Assignee: DogLeg Right Corporation, Dallas, TX (US)

Reexamination Request:
No. 95/000,361, Apr. 7, 2008

Reexamination Certificate for:

| | |
|---|---|
| Patent No.: | **7,004,852** |
| Issued: | **Feb. 28, 2006** |
| Appl. No.: | **10/043,421** |
| Filed: | **Jan. 10, 2002** |

Certificate of Correction issued Apr. 24, 2007

(51) Int. Cl.
*A63B 53/04* (2006.01)

(52) U.S. Cl.
USPC ..... 473/332; 473/334; 473/338; 473/339; 473/349

(58) Field of Classification Search
None
See application file for complete search history.

(56) References Cited

To view the complete listing of prior art documents cited during the proceeding for Reexamination Control Number 95/000,361, please refer to the USPTO's public Patent Application Information Retrieval (PAIR) system under the Display References tab.

*Primary Examiner* — Cary E. Wehner

(57) ABSTRACT

A golf club head that allows a user to customize the location of the center of gravity. The golf club head comprises a club head having a hollow cavity with a weighting port. The weighting port allows a user to place weighting material inside the hollow cavity, customizing the location of the center of gravity, the swing weight, the total weight, and the balance of the golf club.

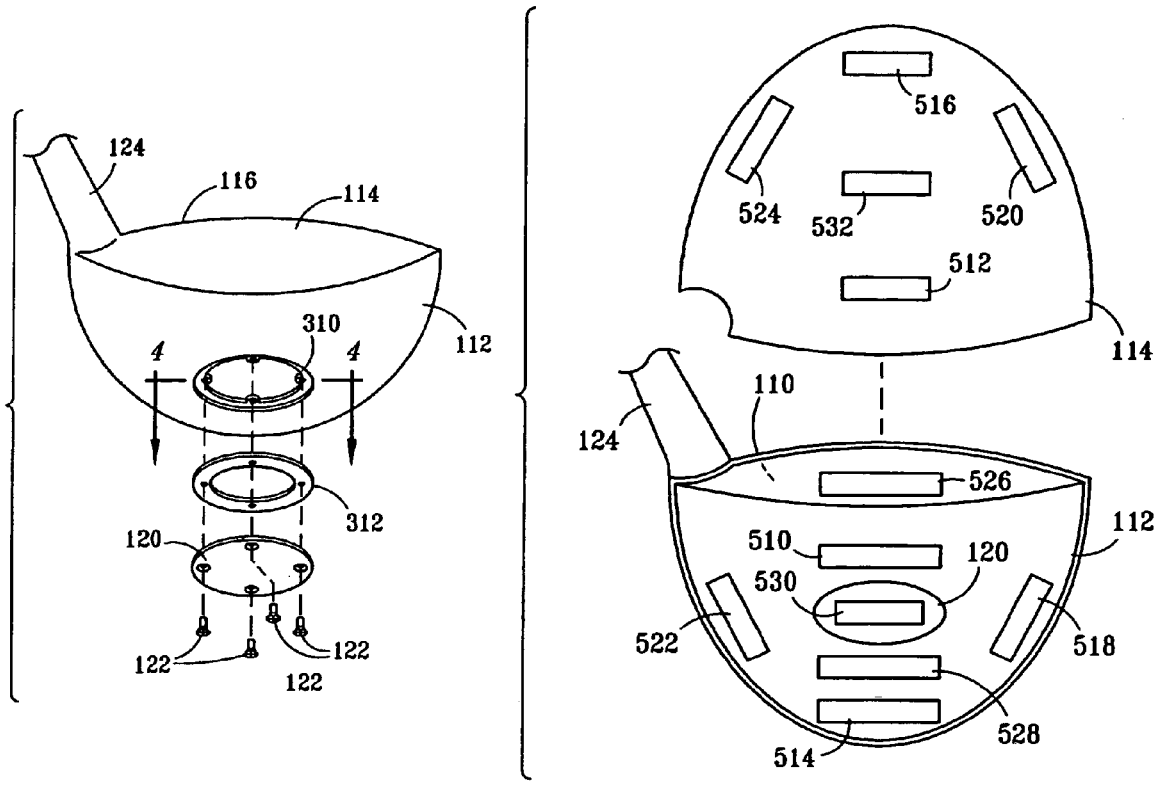

INTER PARTES REEXAMINATION CERTIFICATE ISSUED UNDER 35 U.S.C. 316

THE PATENT IS HEREBY AMENDED AS INDICATED BELOW.

AS A RESULT OF REEXAMINATION, IT HAS BEEN DETERMINED THAT:

Claims 1-7 are cancelled.

* * * * *